United States Patent [19]

Reis

[11] 4,231,570

[45] Nov. 4, 1980

[54] SAFETIED EXERCISING BOARD APPARATUS, AND METHOD OF SAFETYING EXERCISING BOARD APPARATUS

[76] Inventor: Robert V. Reis, 5 Marguerite La., Towaco, N.J. 07082

[21] Appl. No.: 909,203

[22] Filed: May 25, 1978

[51] Int. Cl.[3] ..... A63B 00/00

[52] U.S. Cl. ..... 272/123

[58] Field of Search ..... 272/117–123, 272/134, 144

[56] References Cited

U.S. PATENT DOCUMENTS

| | | | |
|---|---|---|---|
| 2,048,587 | 7/1936 | Averill | 272/144 |
| 2,817,522 | 12/1957 | Margulies | 272/144 |
| 3,118,668 | 1/1964 | Callahan | 272/123 |
| 3,235,255 | 2/1966 | Leflar | 272/123 |
| 3,268,224 | 8/1966 | Freshour | 272/123 X |
| 3,501,140 | 3/1970 | Eichorn | 272/144 X |
| 3,874,657 | 4/1975 | Niebojewski | 272/144 X |

FOREIGN PATENT DOCUMENTS

| | | | |
|---|---|---|---|
| 748316 | 12/1966 | Canada | 272/123 |
| 779572 | 1/1935 | France | 272/123 |
| 1447999 | 6/1966 | France | 272/123 |

*Primary Examiner*—Richard J. Apley
*Attorney, Agent, or Firm*—Thomas N. Neiman

[57] ABSTRACT

The apparatus essentially comprises a press bench used by weight lifters. It includes a horizontal bearing surface upon which the weight lifter/exerciser reclines in a supine attitude, and uprights fixed to the head of the bearing surface for supporting thereupon, above the bearing surface, weight-crossbars. To guard against any untoward accident, in which a falling or otherwise uncontrolled weight-crossbar could impact upon a supine exerciser, the invention teaches the deployment of two safety bars for intercepting such weight-crossbar. One end of each of the safety bars is pivotably joined to a side of the bearing surface, and the other end is placed against a rest stop slidably engaged with, and pinned to, the associated or complementary upright. The safety bars reach across the shoulders of the exerciser, and within the arms thereof, so as to not impede or obstruct normal exercising. The novel method comprises coupling uprights to an exercising board apparatus, and fixing movable rest stops on the uprights to receive pivotable safety bars thereupon, the latter being pivotably fixed to the board apparatus.

3 Claims, 3 Drawing Figures

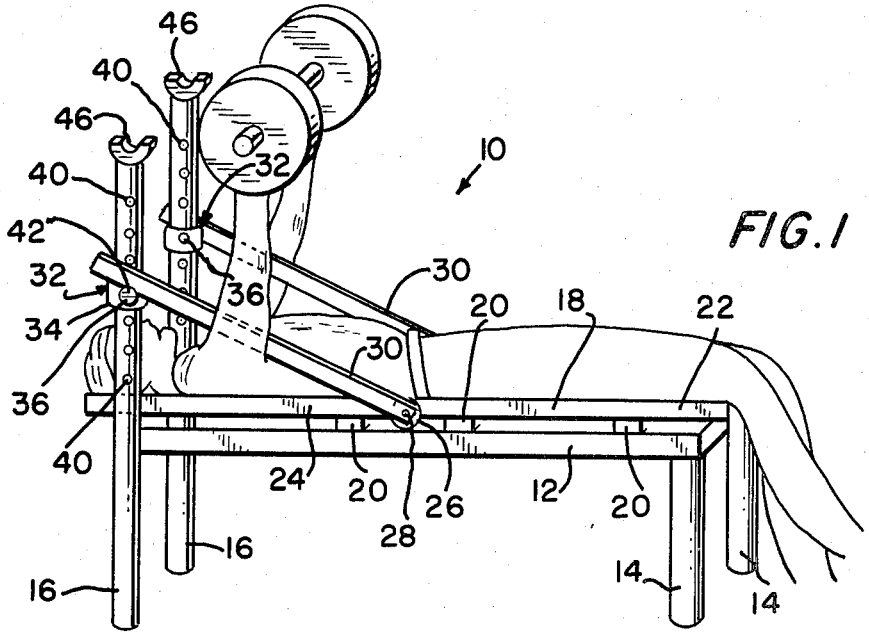
FIG. 1
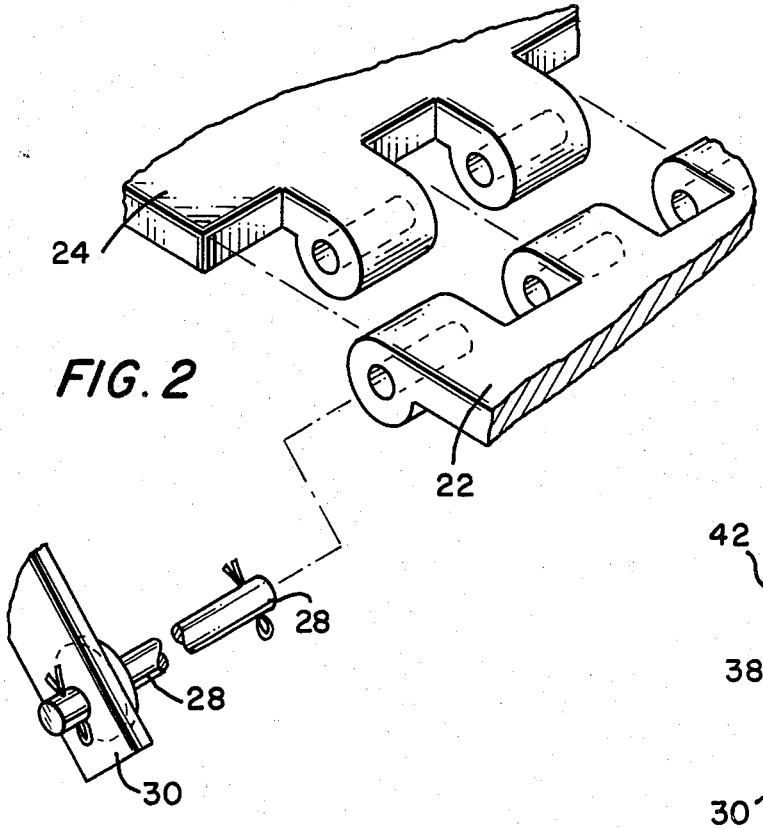
FIG. 2
FIG. 3
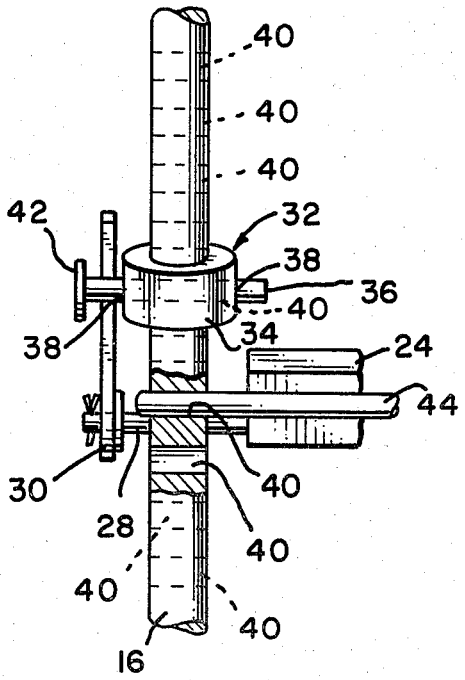

SAFETIED EXERCISING BOARD APPARATUS, AND METHOD OF SAFETYING EXERCISING BOARD APPARATUS

This invention pertains to exercising apparatus, and in particular to exercising board apparatus of the types generally identified as supine press benches or low exercise benches, and typically used by weight lifters.

Each year more and more young people take up weight lifting. Though sporting equipment manufacturers constantly furnish information explaining to the novice lifter the dangers of lifting alone, many serious accidents are reported each year. The most common and, unfortunately, the most catastropic of these weight lifting related accidents occurs when a new lifter over extends himself doing repetitions on an open bench. While "bench pressing" the lifter lies on a horizontal bench and pushes weight on a crossbar above his shoulders and neck. If the lifter should lose control or suddenly cramp, the weight will come crashing down; the results can be fatal. It is an object of this invention to set forth means and a method for safetying an exercising board to guard against accidents of the type just noted. In the prior art there is U.S. Pat. No. 3,118,668, issued to G. Callahan, on Jan. 21, 1964, for a Barbell Exercising Device which, like the instant invention, was drawn to the purpose of preventing accidents from occurring during weight-lifting. However, the Callahan Device is concerned with barbell "push-ups" performed by an exerciser standing erect within the Device. The patented Device does not lend itself to use with supine press benches or low exercise benches. The instant invention, then, meets a long felt need for safetied, supine exercising boards.

Specifically it is an object of this invention to teach safetied exercising board apparatus, comprising board means of a given length for supporting an exerciser thereupon in at least a generally supine position; an upright coupled to said board means; and means fixed to said board means, at a location thereon intermediate the length thereof, and engageable with said upright, for receiving thereupon a falling or otherwise uncontrolled weight-crossbar, to prevent such crossbar from freely impacting upon an exerciser supine on said board means.

Further objects of this invention, as well as the novel features thereof, will become more apparent by reference to the following description taken in conjunction with the accompanying figures, in which:

FIG. 1 is an isometric projection of an embodiment of the invention, the same showing an exerciser supine and in use of the invention;

FIG. 2 is an isometric exploded view of a portion of the horizontal bench, greatly enlarged over the scale of FIG. 1, showing how the boards of the FIG. 1 embodiment are hinged together; and FIG. 3 is a fragmentary illustration of one of the uprights of the FIG. 1 embodiment, the same being in substantially the same scale as FIG. 2.

As shown in figures, the safetied exercising board apparatus 10 comprises a platform 12 which is maintained horizontal and in elevation by a pair of legs 14 at the foot thereof, and a pair of uprights 16 at the head. Fixed upon the platform 12 is a board assembly 18; spacer bars extending across the platform, and denoted by index number 20, support the board assembly 18 thereupon.

The board assembly 18 comprises a pair of boards 22 and 24 which are hingedly joined at 26 in order that board 24 might be elevated. Each of the boards 22 and 24 has a "hinge" edge which interfits with that of the other, and a hinge pin 28 makes a close sliding fit with the "hinge" edges to complete the pivot joint.

An end of the hinge pin 28 projects from the side of the joint and pivotably receives thereat a linear safety bar 30. One end of the bar 30 is bored through to accept the pin 28; the other end of the bar 30 is swung through an arc and brought to rest against a rest stop 32. The rest stop comprises a collar 34 which is traversely apertured to effect pin-hole alignment or registry of the apertures therein with like apertures formed in the upright 16. A locking pin 36 engages the apertures 38 in the collar and the apertures 40 in the upright. A shank portion of the pin, adjacent to the head 42 thereof, provides a bearing surface for the safety bar 30.

It is to be noted that, as depicted in FIG. 1, the safety bars 30 pass within the arms of the exerciser and reach above the shoulders thereof. If the weights were to crash on the bars, due to lifter fatigue, the bars would keep the crossbar from hitting the lifter. Even so the lifter has free exercising movement; the shoulders and arms are not restrained by the bars 30. If a lifter should get "in difficulty" with the weight coming down upon the bars 30, he will be able to sit up—after regaining his strength—by raising the bars 30 from the rest stops 32 and allowing the weight crossbar to slide down the bars 30 to his lap. In this, he will raise the bars with his shoulders simply by coming to a sitting position. According to my invention, where the hinge pin 28 provides a dual function of hinging the boards 22 and 24, and fixing an end of the safety bars 30, the upright apertures 40 also serve two purposes. As already noted, they receive the locking pin 36. In addition, a dowel 44 is provided for extending fully across the apparatus 10 and through the apertures 40 at each side—to support a head end of panel or board 24 thereupon. Accordingly, when it is desired to elevate board 24, selected apertures and dowel 44 are used, as shown in FIG. 3 in part. As will be apparent, the safety bars 30 are usable with board 24 horizontal or in elevated inclination. When the bars 30 are not in use, they are simply rotated and brought to rest against the floor.

While I have described my invention in connection with a specific embodiment thereof it is to be clearly understood that this is done only by way of example and not as a limitation to the scope of my invention as set forth in the objects thereof and in the appended claims. For instance, in the depicted embodiment, the head end of board 24 swings between the uprights 16—coming to rest upon a spacer bar, or the dowel. Clearly, other "stops" for the board 24 could be employed. The uprights 16 have weight crossbar supports 46 fixed at the uppermost portions thereof, and comprise forward feet for the platform and board assembly 18. Alternatively, of course, the uprights could be devoid of crossbar supports and could likewise be independent of any feet or horizontal supports for the apparatus 10. Any such alternative embodiments are believed to be within the ambit of my invention and to proceed from my teaching.

During manufacture of press benches, for instance, such may be safetied by fixing at least one upright, like uprights 16, generally adjacent to a place on the bench whereat the head of a supine exerciser would be positioned. Then it will remain only to fix safety bars, like bars 30, to the bench and rest stops (like stops 32) to the upright—to receive the safety bars thereupon. Hence, from the foregoing description, those skilled in the art may take teaching in how and by what method to safety exercising board apparatus.

I claim:

1. Safetied exercising board apparatus, comprising:

board means of a given length for supporting an exerciser thereupon in at least a generally supine position;

an upright coupled to said board means, substantially adjacent one end of said board means; and elongate means, having one end thereof fixed to said board means, at a location intermediate the length of said board means, the opposite end of said elongate means being engageable with said upright, with a freely-displaceable, contacting engagement, in a plane elevated from said board means, for receiving thereupon a falling or otherwise uncontrolled weight-crossbar, to prevent such crossbar from freely impacting upon an exerciser supine on said board means;

wherein said elongate means comprises means for deflecting such a falling or uncontrolled weight-crossbar away from said upright and toward said intermediate location;

said elongate and deflecting means further comprises a linear safety bar pivotably coupled at one of opposite ends thereof to said board means at said intermediate location; and further including rest stop means coupled to said upright for receiving the other of said opposite ends of said safety bar thereupon; wherein said upright has means for receiving a weight-crossbar thereupon and for supporting such crossbar in elevation above said board means; and said board means comprises a pair of boards pivotably joined in traverse of said apparatus at said intermediate location;

said board means further comprises hinge means pivotably joining said boards of said pair together;

said hinge means includes a hinge pin; and said safety bar one end is pivotably coupled to said hinge pin.

2. Safetied exercising board apparatus, according to claim 1, wherein:

said upright has a series of apertures formed therein equally spaced apart along a length of said upright;

said rest stop means comprises an apertured collar slidably engaged with said upright for effecting registry of an aperture formed in said collar with selected apertures in said upright, and pin means for penetrating registered or aligned apertures in said collar and upright;

said pin means comprising a headed pin for receiving said other end of said safety bar adjacent to said pin head; and dowel means for engaging selected ones of said apertures in said upright for receiving thereupon an end of one of said boards of said pair to cause the latter to be disposed in an inclination.

3. Safetied exercising board apparatus, comprising:

board means of a given length for supporting an exerciser thereupon in at least a supine position;

an upright coupled to said board means, substantially adjacent one end of said board means; and elongate means, having one end thereof fixed to said board means, at a location intermediate the length of said board means, the opposite end of said elongate means being engageable with said upright, with a freely-displaceable, contacting engagement, in a plane elevated from said board means, for receiving thereupon a falling or otherwise uncontrolled weight-crossbar, to prevent such crossbar from freely impacting upon an exerciser supine on said board means;

wherein said elongate means comprises safety bar means pivotably coupled at one of opposite ends thereof to said board means at said intermediate location; and further including rest stop means coupled to said upright for receiving the other of said opposite ends of said safety bar means thereupon; and wherein said upright has a series of apertures formed therein spaced apart along a length of said upright; and said rest stop means comprises an apertured collar slidably engaged with said upright for effecting registry of an aperture formed in said collar with selected apertures in said upright, and pin means for penetrating registered or aligned apertures in said collar and upright;

said pin means comprising a pin having a shank formed thereon for receiving said other end of said safety bar means.

* * * * *